United States Patent [19]

Oda et al.

[11] 4,219,220

[45] Aug. 26, 1980

[54] RECORDING MATERIAL FOR USE IN A PRESSURE SENSITIVE COPYING SYSTEM

[75] Inventors: Shinichi Oda; Shoji Aoyagi; Takio Kuroda; Eishun Tozaki, all of Hyogo, Japan

[73] Assignee: Kanzaki Paper Manufacturing Co., Ltd., Tokyo, Japan

[21] Appl. No.: 38,233

[22] Filed: May 11, 1979

[30] Foreign Application Priority Data

May 15, 1978 [JP] Japan ..... 53-57902

[51] Int. Cl.[3] ..... B41M 5/22

[52] U.S. Cl. ..... 282/27.5; 427/150; 427/151; 427/203; 427/204; 427/205; 428/307; 428/328; 428/331; 428/914

[58] Field of Search ..... 106/21; 282/27.5; 427/150, 151, 203–205, 152; 428/307, 411, 537, 913, 914, 328, 331, 323

[56] References Cited

U.S. PATENT DOCUMENTS

| | | | |
|---|---|---|---|
| 3,894,168 | 7/1975 | Brockett et al. | 428/150 X |
| 4,154,462 | 5/1979 | Golden et al. | 282/27.5 X |

FOREIGN PATENT DOCUMENTS

| | | | |
|---|---|---|---|
| 52-51215 | 4/1977 | Japan | 282/27.5 |

*Primary Examiner*—Bruce H. Hess

*Attorney, Agent, or Firm*—Morgan, Finnegan, Pine, Foley & Lee

[57] ABSTRACT

A recording material for use in a pressure sensitive copying system has an undercoating layer which is formed on a surface of a base sheet and on which a color former coating layer including microcapsules each encapsulating an oil droplet containing a color former material dissolved or dispersed therein. The undercoating layer comprises finely divided inorganic pigment particles and a binder and is substantially unreactive with the color former material included in the color former layer.

12 Claims, No Drawings

RECORDING MATERIAL FOR USE IN A PRESSURE SENSITIVE COPYING SYSTEM

BACKGROUND OF THE INVENTION

This invention relates to a recording material having a color former coating layer formed by coating on a surface of a base sheet a coating composition including microcapsules each encapsulating a hydrophobic material containing an electron donating organic chromogenic material and more particularly to such recording material having a good ballpoint pen writability and a good printability.

Among recording materials there are well known pressure-sensitive copying papers and heat-sensitive recording papers which utilize the color developing reaction between electron donating organic chromogenic material (hereinafter referred to as "color former") and electron accepting acidic reactant material (hereinafter referred to as "acceptor"). In pressure-sensitive copying paper at least one of the color former and the acceptor is contained in microcapsules so as to be isolated from the other and they become into contact with each other by rupturing such microcapsules to develop a color. In a most typical type of pressure-sensitive copying paper minute oil droplets in which the color former is dispersed or dissolved are encapsulated and coated onto papers.

Usually the pressure sensitive copying system utilizing the above-mentioned pressure sensitive copying papers consists of three kinds of sheets such as a top sheet, at least one middle sheet and a bottom sheet, wherein the top sheet is coated on the underside thereof with a composition consisting mainly of pressure rupturable microcapsules each enclosing an oil droplet containing a color former dissolved or dispersed therein, the middle sheet is coated on the upperside thereof with another composition consisting mainly of an acceptor and also is coated on the underside thereof with the composition of microcapsules containing an oil droplet in which a color former is dissolved or dispersed and the bottom sheet is coated on the upperside thereof with the composition of an acceptor. Any partial pressing on the upperside of the top sheet of the thus prepared copying system with a pen or a typewriter will break the microcapsules positioned on the pressing, resulting in making the color former react with the acceptor so as to develop a color only on the part pressed.

In another pressure sensitive copying system, there are disposed on one surface of the same sheet both the acceptor and the microcapsules containing oil droplets in which the color former is dissolved or dispersed. This system is known as the "self contained" system.

Among known color former compounds for pressure sensitive copying paper there are included triarylmethane derivatives such as 3,3-bis(p-dimethylaminophenyl)-6-dimethylaminophthalide (CVL), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis-(1,2-dimethylindole-3-yl)-6-dimethylaminophthalide, 3,3-bis-(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrrole-2-yl)-6-dimethylaminophthalide, diphenylmethane derivatives such as 4,4'-bis-dimethylaminobenzhydrylbenzylether, N-halophenyl-leucoauramine, N-2,4,5-trichlorophenyl-leucoauramine, Xanthene derivatives such as rhodamine-B-anilinolactam, rhodamine-(p-nitro-anilino)lactam, rhodamine-(p-chloroanilino)lactam, fluoran compounds such as 3-dimethylamino-7-methoxyfluoran, 3-diethylamino-7-methoxyfluoran, 3-diethylamino-6-methoxyfluoran, 3-diethylamino-6-chlorofluoran, 3-diethylamino-6-chloro-7-methylfluoran, 3-diethylamino-6,7-dimethylfluoran, 3-diethylamino-7-acethylaminofluoran, 3-diethylamino-6-methylaminofluoran, 3,7-diethylaminofluoran, 3-diethylamino-7-dibenzylaminofluoran, 3-diethylamino-7-(methylbenzylamino)fluoran, 3-diethylamino-7-(N-chloroethyl-N-methylamino)fluoran, 3-diethylamino-7-diethylaminofluoran, 3-(N-ethyl-N-p-toluyl)amino-6-methyl-7-phenylaminofluoran, thiazine derivatives such as benzoylleucomethyleneblue, spiropyrane derivatives such as p-ethyl-spiro-dinaphthopyrane, 3,3'-dichlorospiro-dinaphthopyrane, 3-benzylspiro-dinaphthopyrane, 3-methylnaptho-( 3-methoxy-benzo)-spiropyrane and 3-propyl-spiro-dibenzopyrane. These compounds are used either solely or in combination.

Various natural and synthetic oils are used either solely or in combination for dissolving or dispersing the color former compound. Among them there are included cotton seed oil, linseed oil, soybean oil, castor oil, alkylbenzene, hydrogenated terphenyl, hydrogenated terphenyl derivatives, alkylbiphenyl, alkylnaphthalene, diarylalkane, kerosene, paraffin and naphthene oil.

The most typical method for making oil droplet-containing microcapsules for the above mentioned purpose is to utilize the coacervation technique, e.g., as disclosed in U.S. Pat. No. 2,800,457 and U.S. Pat. No. 2,800,458. Various other methods for making oil droplet-containing microcapsules are also useful. Among them there are included the interfacial polymerization technique as disclosed Japanese Patent Publication No. 771 of 1967 and the in-situ polymerization technique as disclosed in Japanese Laid Open Patent Publication No. 9, 079 of 1976.

Among the useful acceptor compounds to develop a color in contact with an organic color former, there are included inorganic acid materials such as acidic clay, activated clay, calcined activated clay and attapulgite, and organic acceptors such as phenolic compounds, phenole-aldehyde polymers, phenol-acetylene polymers, maleic acid-rosin resin, hydrolyzed styrene-maleic anhydride copolymer, aromatic carboxylic acids e.g. salicylic acid and their derivatives and their metal salts.

Pressure sensitive copying papers found their usefulness in various commercial applications such as computer output recording papers, business forms and copying slips. In some cases the microcapsule coated surface of the pressure sensitive copying paper has a form printing for writing thereon by a pencil or ballpoint pen. In those cases the microcapsule coated surface of the pressure sensitive copying paper must have a good printability and a good ballpoint pen writability. However, there are many difficulties to be overcome to achieve this requirement. For example, in case of the ballpoint pen writing, the oil included in microcapsules often causes coagulation of the ballpoint pen ink and produces ink and oil smudges adhered to a ballpoint pen ball with the result that smooth rotation of the ballpoint pen ball is prevented.

Some attempts have been made to overcome the above mentioned difficulties. For example, it was proposed to add inorganic pigment particles to the microcapsule coating composition. Another attempt was to form an overcoating layer of inorganic pigment particles on the microcapsule coating layer, as disclosed in Japanese Laid Open Patent Publication No. 51,215 of 1977. However, these two attempts involve to decrease the color formability which is one of the most important requirements for the pressure sensitive copying papers. A further attempt was to add a carbazole derivative to the oil encapsulated in the microcapsules, as disclosed in Japanese Laid Open Patent Publication No. 150,118 of 1977. The attempt fails to obtain a satisfactorily good ballpoint pen writability as desired.

The principal object of the invention is to provide an improved recording material having a color former microcapsule coating layer in which the microcapsule coated surface has a good ballpoint pen writability and a good printability without sacrificing the color formability of the color former layer.

Other objects and advantages of the invention will be apparent from the following description.

SUMMARY OF THE INVENTION

The recording material for use in a pressure sensitive copying system comprises a base sheet, an undercoating layer formed on a surface of said base sheet and a color former coating layer including microcapsules each encapsulating an oil droplet containing a color former material dissolved or dispersed therein. The undercoating layer comprises finely divided inorganic pigment particles and a binder and is substantially unreactive with the color former material included in the color former layer.

DETAILED DESCRIPTION OF THE INVENTION

The material for the finely divided inorganic pigment particles included in the undercoating layer of the recording material according to the invention may be any of polyvalent metal carbonates such as calcium carbonate and magnesium carbonate, polyvalent metal oxides such as zinc oxide, titanium oxides and magnesium oxide, polyvalent metal hydroxides such as aluminum hydroxide and zinc hydroxide, polyvalent metal silicates such as magnesium silicate and aluminum silicate and clay minerals such as kaolin, talc, zeolite, clay, calcined kaolin, pumice and physically or chemically deactivated products from inorganic acceptor materials e.g. attapulgite, acidic clay and activated clay. These compounds may be used either solely or in combination.

Most of the above-mentioned inorganic pigment materials are substantially unreactive with the hydrophobic color former material for use in the pressure sensitive copying system. Accordingly, by the utilization of any of those unreactive materials it is easily possible to form an undercoating layer which is substantially unreactive with the color former material so that any substantial color development on the microcapsule coated surface can be prevented when microcapsules are ruptured as by writing with a ballpoint pen.

However, some of the above-mentioned inorganic pigment materials such as kaolin and zeolite are somewhat reactive with the color former material. In these cases, the substantially unreactive undercoating layer can be formed by controlling the amount of the undercoating composition applied and/or the amount of the binder included in the undercoating composition.

Inorganic pigment materials, such as activated clay, acidic clay and attapulgite, which are known as acceptors for the pressure sensitive copying system, can only be used as the material included in the undercoating layer according to the invention after a physical or chemical treatment for deactivation such as a dipping or overcoating treatment with a strong alkaline material or a desensitizing composition.

The term "substantially unreactive with the color former material" generally means that no appreciable color image is developed on the microcapsule coated surface in the case where a recording material having a color former microcapsule layer prepared according to the invention is superposed on a wood free paper sheet with the microcapsule coated surface of the former being in contact with the top surface of the latter and a writing pressure either in the form of a straight line drawing pressure with a load of 200 g or in the form of typewriting pressure of the "+" magnitude with use of HERMES 700EL typewriter (PAILLARD, Switzerland) is applied to the superposed sheets from the uncoated top surface of the recording material.

The undercoating layer according to the invention may preferably be formed by coating on a surface of a base sheet, such as natural paper, synthetic paper or synthetic film, a coating composition comprising a proper dispersion medium such as water or an organic solvent, finely divided inorganic pigment particles dispersed in said medium and a binder through the utilization of a conventional coating technique as by using a coater or size press.

The binder included in the coating composition serves to firmly bind the above-mentioned finely divided inorganic pigment particles to each other and with the base sheet surface. Among the useful binder materials, there are included various natural and synthetic binders, such as casein, starch, gum arabic, carboxy methylcellulose, gelatin, polyvinyl alcohol and other synthetic polymer latexes. The amount of the binder depends on its property and the nature of organic pigment particles used. Generally, the amount of the binder used in the coating composition is within the range of 1 to 100 parts by weight, more preferably within the range of 5 to 50 parts by weight, per 100 parts by weight of the inorganic pigment particles used.

The coating composition for forming the undercoating layer according to the invention may also additionally include any other various agents conventionally used for the pressure sensitive copying paper making technique. Among those agents, there may be included dispersing agents such as sodium alginate and sodium polyacrylate, a viscosity regulator, an antifoaming agent, starch powder, and pulp powder.

The amount of the coating composition applied for forming the undercoating layer according to the invention may be at least 0.1 $g/m^2$ on dry basis, preferably within the range of 0.2 to 5 $g/m^2$ on dry basis, the upper limit of the amount of the coating composition applied is mainly decided from economic viewpoint.

According to the invention, a color former coating layer is formed on the thus formed undercoating layer. The color former layer includes microcapsules, each encapsulating an oil droplet containing a color former material dissolved or dispersed therein. This color former coating layer may be formed through the utilization of any known conventional technique. There is no limitation about the preparation of the microcapsule coating composition, the coating technique and the amount of the coating composition applied. For example, the coating may be carried out with use of an airknife coater, blade coater, roll coater, gravure coater or printing machine. Generally, the amount of the coating composition applied is within the range of 0.5 to 15 g/m$^2$ on dry basis, preferably 1 to 6 g/m$^2$ on dry basis.

The recording material thus prepared according to the invention has a very good ballpoint pen writability and a good printing ink receptivity on the microcapsule coated surface thereof. This is owing to existence of the undercoating layer. The recording material according to the invention is prevented from being smudged with incidental and undesirable color images developed on the microcapsule coated surface thereof because the undercoating layer is substantially unreactive with the hydrophobic color former material encapsulated in the microcapsules. In addition, through the undercoating layer formed according to the invention any typewriting pressure from the exposed top surface of the recording material can be transmitted without errors to the microcapsule coating layer on the opposite surface of the recording material and the acceptor layer to produce sharp color images. The recording material according to the invention finds its typical usefulness as top or middle sheet of the usual pressure sensitive copying papers.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively. (Preparation of capsule coating composition)

65 parts of an acid-treated gelatin having an isoelectric point of 8.0 was added to 585 parts of water and permitted to stand for one hour at 10° C., and then the mixture was heated at 60° C. to prepare a gelatin solution.

On the other hand, 5.2 parts of crystal violet lactone and 2.6 parts of benzoyl leucomethylene blue were dissolved in a mixed oil consisting of 78 parts of kerosene and 182 parts of isopropylnaphthalene to prepare a color former solution. The color former solution was, after being heated at 60° C., added to the gelatin solution and the mixture was emulsified with a homomixer so as to obtain oil droplets having an average particle size of 3.0 microns. To the emulsion were added 1300 parts of warm water of 55° C. and then 130 parts of 5% aqueous solution of carboxymethyl-cellulose having an average polymerization degree of 160 and an etherification degree of 0.6 (the amount of the carboxymethylcellulose being 10% by weight on the basis of the gelatin amount). The pH of the aqueous system thus obtained was adjusted to 5.4 with 10% aqueous solution of sodium hydroxide. The aqueous system was cooled until 10° C. with stirring to obtain multinucleus capsules. The particle size distribution of the multi-nucleus capsules was measured by Coulter Counter manufactured by Coulter Electronics Inc., USA. The average particle size of the capsules was 8.2 microns.

To the system maintained at 10° C., 13 parts of 50% aqueous solution of glutaric aldehyde was added under stirring and then the pH of the system was adjusted to 6.0 with 10% aqueous solution of sodium hydroxide to obtain a capsule dispersion. The capsule dispersion was mixed up sufficiently with 80 parts of pulp powder and then 150 parts of 20% aqueous solution of oxidized starch and 75% parts of 20% aqueous solution of an alkali salt of methacrylic acid-buthylmethacrylate copolymer were added to the mixture under stirring to prepare a capsule coating composition.

EXAMPLE 1

100 Parts of aluminum hydroxide having a maximum particle size of 3 microns was dispersed into 150 parts of water containing 0.5 parts of sodium polyacrylate, and then 20 parts of 10% aqueous solution of polyvinyl alcohol and 30 parts of 48% latex of carboxylated styrene-butadiene copolymer were added to the dispersion to prepare a coating composition.

Thus obtaine coating composition was coated on one surface of paper of 40 g/m$^2$ in an amount of 2 g/m$^2$ on dry basis and dried to obtain a first coating layer. The above capsule coating composition was coated on the first coating layer in an amount of 5 g/m$^2$ on dry basis and dried to form a second coating layer and to obtain capsule coated paper.

EXAMPLE 2

100 Parts of calcium carbonate was dispersed into 250 parts of water containing 0.5 parts of sodium polyacrylate, and then 300 parts of 10% aqueous solution of starch was added to the dispersion to obtain a coating composition. Thus obtained coating composition was coated on one surface of paper of 40 g/m$^2$ in an amount of 2 g/m$^2$ on dry basis and dried to form a first coating layer. As in Example 1, the above capsule coating composition was coated on the first coating layer and dried to prepare a capsule coated paper.

EXAMPLE 3

100 Parts of Georgia Kaolin was dispersed into 340 parts of water containing 0.4 parts of sodium hexa-metaphosphate and then 40 parts of 48% latex of styrene-butadiene copolymer was added to the dispersion to obtain a coating composition. Thus obtained coating composition was coated on one surface of paper of 40 g/m$^2$ in an amount of 0.5 g/m$^2$ on dry basis and dried to form a first coating layer. As in Example 1, the above capsule coating composition was coated on the first coating layer and dried to prepare a capsule coating paper.

EXAMPLE 4

100 Parts of aluminum hydroxide having a maximum particle size of 3 microns was dispersed into 270 parts of water containing 0.5 parts of sodium polyacrylate and then 250 parts of 10% aqueous solution of oxidized starch and 10 parts of 1% aqueous solution of carboxymethylcellulose were added to obtain a size press liquid. The both surfaces of paper of 40 g/m$^2$ was size pressed with the size press liquid to obtain sized paper containing aluminum hydroxide in an amount of 2.3 g/m$^2$ on dry basis. As in Example 1, the above capsule coating composition was coated on the sizing layer and dried to prepare capsule coated paper.

EXAMPLE 5

100 Parts of activated clay whose activity had been removed by dipping the clay in a conc-NaOH solution was dispersed into 260 parts of water containing 0.5 parts of sodium hexa-metaphosphate and then 40 parts of 48% latex of carboxylated styrene-butadiene copolymer was added to the dispersion to prepare a coating composition. The coating composition was coated on a surface of paper of 40 g/m$^2$ and dried to form a first coating layer in an amount of 3 g/m$^2$ on dry basis. As in Example 1, the above capsule coating composition was coated on the first coating layer and dried to prepare a capsule coating paper.

EXAMPLE 6

50 Parts of aluminum hydroxide having a maximum partilce size of 3 microns was dispersed into 120 parts of water comprising 0.3 parts of sodium polyacrylate and then 50 parts of starch powder was further dispersed into the aqueous system. 50 Parts of 10% aqueous solution of starch of 40 parts of 48% latex of carboxylated styrene-butadiene copolymer were added to the dispersion to prepare a coating composition. The coating composition was coated on one surface of paper of 40 g/m$^2$ in an amount of 2 g/m$^2$ on dry basis to form a first coating layer. As in Example 1, the above capsule coating composition was coated on the first coating layer to prepare capsule coating paper.

EXAMPLE 7

Example 1 was repeated except that titanium oxide was used instead of aluminum hydroxide to prepare a capsule coated paper.

CONTROL 1

The above capsule coating composition was coated directly on one surface of paper of 40 g/m$^2$ and dried to prepare a capsule coated paper.

CONTROL 2

Example 5 was repeated except that a usual activated clay was used instead of the activated clay whose activity had been removed to prepare a capsule coated paper.

The properties of capsule coated papers obtained in Examples and Controls were examined with use of acceptor coated paper prepared by the following method.

(Preparation of acceptor coated paper)

70 Parts of zinc 3,5-di($\alpha$-methylbenzyl)salicylate and 30 parts of styrene-$\alpha$-methylstyrene copolymer were mixed and melted in an extruder at 150° C. and the mixture was cooled until room temperature and pulverized to obtain an acceptor. 20 parts of the acceptor, 25 parts of zinc oxide, 30 parts of aluminum hydroxide and 25 parts of activated clay were dispersed into 400 parts of water containing 5 parts of 20% aqueous solution of sodium polyacrylate and 20 parts of 10% aqueous solution of polyvinyl alcohol and further treated with a sand grinder to obtain a good dispersion. To the dispersion, 40 parts of 20% aqueous solution of oxidized starch and 30 parts of 48% latex of carboxylated styrene-butadiene copolymer were added under stirring to prepare an acceptor coating composition. The acceptor coating composition was coated on one surface of paper of 40 g/m$^2$ in an amount of 6 g/m$^2$ on dry basis, dried and calendered to obtain acceptor coated paper.

(Test for color developability)

Each capsule coated paper was put on the acceptor coated paper in the manner as the capsule coating layer was faced on the acceptor coating layer. Then the upper surface of the capsule coated paper was typewritten with a typewriter (HERMES 700 EL manufactured by Paillard Company, Switzerland) under pressure of the "+" magnitude. After 24 hours the color density of the images formed on the acceptor coating layer and the capsule coating layer was measured in terms of absorbance at a light wave length of 610 m$\mu$ by a spectrophotometer (Hitachi Double Beam Spectrophotometer manufactured by Hitachi, Ltd., Japan) with use of MgO plate as a standard.

(Test for writability)

Letters and figures were written on the capsule coating layer of the capsule coated paper with four commercial ballpoint pens, and the transferability of inks, the continuous writability and the continuability of a line were examined with the naked eye.

The test results were shown in Table 1. As shown in Table 1, every capsule coated paper according to the invention was very superior, in the writability with ballpoint pens, to usual capsule coated paper (Control 1) in which the capsule coating layer was formed directly on paper without any other coating layer. Further, using the capsule coated paper according to the invention, clear color images were formed on the acceptor coated paper and the color developability was also superior. Since the capsule coated paper obtained in Control 2 had a capsule coating layer which was formed on a coating layer containing activated clay highly reactive to organic color former materials, color developing occured on the capsule coating layer and resultantly the written letters were hard to read due to the mixture of them with the developed color images. Highly color developing was observed on the capsule coating layer of such a capsule coating paper as in Control 2 by only bending the capsule coated paper. However, using a capsule coated paper according to the invention, there was never developed color on the capsule coating layer. Accordingly, written letters with a ballpoint pen were very clear and easy to read. Smudges due to color developing were not grown on the capsule coated paper by the usual handling.

TABLE

| | Color Developability | | Writability | | | |
|---|---|---|---|---|---|---|
| | Acceptor Coating Layer | Capsule Coating Layer | A | B | C | D |
| Example 1 | 0.70 | 0.04 | O | ⊙ | O | ⊙ |
| Example 2 | 0.65 | 0.04 | O | O | O | O |
| Example 3 | 0.62 | 0.08 | Δ | O | Δ | O |
| Example 4 | 0.63 | 0.04 | O | O | O | O |
| Example 5 | 0.64 | 0.02 | O | ⊙ | O | O |
| Example 6 | 0.70 | 0.04 | O | O | O | O |
| Example 7 | 0.65 | 0.04 | Δ | O | Δ | O |
| Control 1 | 0.56 | 0.02 | X | X | X | X |
| Control 2 | 0.62 | 0.32 | O | O | O | O |

(Note) A is a ballpoint pen manufactured by Zebra Kabushiki Kaisha.
B is a ballpoint pen manufactured by Mitsubishi Pencil Kabushiki Kaisha.
C is a ballpoint pen manufactured by Pilot Man-Nen-Hitsu Kabushiki Kaisha.
D is a ballpoint pen manufactured by The Parker Pen Company.
⊙: superior
O: good
Δ: slightly good
X: bad

What we claim is:

1. A recording material for use in a pressure sensitive copying system comprising a base sheet, an undercoating layer formed on a surface of said base sheet and a color former coating layer formed on said undercoating layer, said color former layer including microcapsules each encapsulating an oil droplet containing a color former material dissolved or dispersed therein, and said undercoating layer comprising finely divided inorganic pigment particles and a binder said undercoating layer being substantially unreactive with said color former material included in said color former layer, said pigment particles being selected from the group consisting of polyvalent metal carbonates, polyvalent metal oxides, polyvalent metal hydroxides, polyvalent metal silicates and clay minerals.

2. A recording material according to claim 1 in which said finely divided inorganic pigment particles are clay minerals, said clay minerals being selected from the group consisting of kaolin, talc, zeolite, calcined kaolin and pumice.

3. A recording material according to claim 1 in which said finely divided inorganic pigment particles are pivalent metal carbonates, said polyvalent metal carbonates being selected from the group consisting of calcium carbonate and magnesium carbonate.

4. A recording material according to claim 1 in which said finely divided inorganic pigment particles are pivalent metal oxides, said polyvalent metal oxides being selected from the group consisting of zinc oxide, titanium oxide and magnesium oxide.

5. A recording material according to claim 1 in which said finely divided inorganic pigment particles are polyvalent metal hydroxides, said polyvalent metal hydroxides being selected from the group consisting of aluminum hydroxide and zinc hydroxide.

6. A recording material according to claim 1 in which said finely divided inorganic pigment particles are polyvalent metal silicates, said polyvalent metal silicates selected from the group consisting of magnesium silicates and aluminum silicates.

7. A recording material according to claim 1 in which said finely divided inorganic pigment particles are clay minerals, said clay minerals being physically or chemically deactivated products from attapulgite, acid clay and activated clay.

8. A recording material according to claim 1 in which said finely divided inorganic pigment particles are substantially unreactive with said color former material.

9. A recording material according to claim 1, in which said undercoating layer is formed by coating on a surface of said base sheet a coating composition including inorganic pigment particles and binder in an amount of at least 0.1 $g/m^2$ on dry basis.

10. A recording material according to claim 9 in which said coating composition is coated on the surface of said base sheet in an amount of 0.2 to 5 $g/m^2$ on dry basis.

11. A recording material according to claim 9 in which the amount of said binder included in said coating composition is within the range of 1 to 100 parts by weight per 100 parts by weight of said inorganic pigment particles.

12. A recording material according to claim 11 in which the amount of said binder included in said coating composition is within the range of 5 to 50 parts by weight per 100 parts by weight of said inorganic pigment particles.

* * * * *

UNITED STATES PATENT AND TRADEMARK OFFICE

CERTIFICATE OF CORRECTION

PATENT NO. : 4,219,220

DATED : August 26, 1980

INVENTOR(S) : Shinichi Oda, Shoji Aoyagi, Takio Kuroda, Eishun Tozaki

It is certified that error appears in the above—identified patent and that said Letters Patent is hereby corrected as shown below:

Claim 3, lines 14-15: "pivalent" should read -- polyvalent --.

Claim 4, lines 19-20: "pivalent" should read -- polyvalent --.

Signed and Sealed this

*Eighteenth* Day of *November 1980*

[SEAL]

*Attest:*

SIDNEY A. DIAMOND

*Attesting Officer*

*Commissioner of Patents and Trademarks*